US008358075B2

(12) United States Patent
Sejkora et al.

(10) Patent No.: US 8,358,075 B2
(45) Date of Patent: Jan. 22, 2013

(54) DEVICE AND A METHOD FOR CONTROLLING LIGHT EMISSION

(75) Inventors: Guenther Sejkora, Schwarzenberg (AT); Paul Hartmann, Weiz (AT); Eduardo Pereira, Siebnen (CH); Alexander Barth, Alberschwende (AT)

(73) Assignees: Ledon Lighting Jennersdorf GmbH, Jennersdorf (AT); TridonicAtco GmbH & Co., KG, Dornbirn (AT)

( * ) Notice: Subject to any disclaimer, the term of this patent is extended or adjusted under 35 U.S.C. 154(b) by 316 days.

(21) Appl. No.: 12/670,983

(22) PCT Filed: Jul. 31, 2008

(86) PCT No.: PCT/EP2008/006317

§ 371 (c)(1), (2), (4) Date: May 25, 2010

(87) PCT Pub. No.: WO2009/018958

PCT Pub. Date: Feb. 12, 2009

(65) Prior Publication Data

US 2010/0301757 A1 Dec. 2, 2010

(30) Foreign Application Priority Data

Aug. 6, 2007 (DE) ..... 10 2007 036 978

(51) Int. Cl.
*H05B 37/02* (2006.01)

(52) U.S. Cl. ..... 315/158; 315/159; 315/307

(58) Field of Classification Search ..... 315/291, 315/149, 307, 308, 158, 159, 156, 157
See application file for complete search history.

(56) References Cited

U.S. PATENT DOCUMENTS

2009/0121641 A1* 5/2009 Shih ..... 315/157
2009/0174331 A1* 7/2009 Tanaka ..... 315/151

FOREIGN PATENT DOCUMENTS

EP 1056933 12/1999
WO WO2006012737 2/2006
WO WO2006054230 5/2006

* cited by examiner

*Primary Examiner* — David H Vu
(74) *Attorney, Agent, or Firm* — Fish & Associates, PC

(57) ABSTRACT

The invention relates to a device and a method for controlling the light emission (i) of at least three light sources ($2_1$, $2_2$, $2_3$), wherein the light emitted by the light sources ($2_1$, $2_2$, $2_3$) is detected in a sequence of measuring periods during a calibration phase, and calculated on the basis of the information on the brightness of each individual light source ($2_1$, $2_2$, $2_3$) obtained during the measuring periods. In at least one of the measuring periods, the detected light comes from a plurality of the light sources ($2_1$, $2_2$, $2_3$).

19 Claims, 3 Drawing Sheets

DEVICE AND A METHOD FOR CONTROLLING LIGHT EMISSION

FIELD OF THE INVENTION

The present invention relates to a device and method for controlling the light emission from several light sources.

BACKGROUND OF THE INVENTION

In recent years, LEDs or light-emitting semiconductor elements in general have been used increasingly in lighting technology because the powers attainable with light sources of this kind are now sufficiently high for relatively large lighting applications. By comparison with other types of light source, LEDs offer the advantage of a relatively greater efficiency. Furthermore, the power and therefore the brightness of an LED can be adjusted in a relatively simple manner, so that light can be generated in almost any required colour shade through a corresponding mixing of different colours.

However, one problem of LED illuminants of this kind, which provide LEDs of different colours, is that these illuminants are not stable with regard to colour-location without an appropriate control or regulation on the basis of thermal influences or ageing factors. Furthermore, since deviations in the light emission of individual LEDs can occur as a result of manufacture, this means that cost-intensive measures must be adopted in order to adjust the power of the individual LEDs. Otherwise, the risk would arise, that ultimately, the colour shade of the mixed light emitted by the illuminant may not correspond to the user's requirements.

In this context, it is known from the prior art, that light emitted from the different light sources can be detected using a sensor, and a regulation adapted to the test result can be implemented during the control of the LEDs. Since information about the light of each individual light source must be available in order to achieve an accurate colour control, steps are taken especially in order to obtain this information. For example, in the case of a method described in EP 056 993 B1 for operating light sources, a calibration is implemented during operation. In this context, the light sources are controlled temporarily during a calibration phase in such a manner that only an individual light source is active in each case within a sequence of individual measuring periods. The brightness information for the currently active light source can therefore be obtained in each case via the sensor, wherein a corresponding control of the LEDs as a whole is then implemented on the basis of this information. In this context, the individual measuring periods are preferably dimensioned to be so short that the regular operation of the illuminant is influenced as little as possible.

The method described in EP 1 056 993 B1 is used widely for the colour control of LED illuminants, however, it has proved problematic that the different LEDs are activated in each case individually during the calibration phases. The consequence of this is that, in spite of the relatively short measuring periods, in which light from an individual LED or respectively of an individual colour is emitted, slight colour changes in the light emission of the illuminant as a whole can occur, which are perceptible by an observer albeit only slightly. This effect is additionally intensified in that these colour sequences required for the calibration occur regularly. Furthermore, there are limits to the shortening of the individual measuring periods, because peaks, which can falsify the test results, may occur if individual light sources are switched on and off again within an excessively short interval.

SUMMARY OF THE INVENTION

The present invention is therefore based upon the object of providing a novel possibility for controlling LED illuminants, in which measurements or respectively calibrations of the individual light sources implemented during continuous operation, are significantly less perceptible by an observer, if at all.

In principle, the solution according to the invention is once again based upon the known idea of controlling the light sources during operation in recurring calibration phases, in such a manner that, within the sequence of individual measuring periods, light emitted by the light sources is detected by a sensor and evaluated. However, by contrast with the prior art, in which the light sources to be evaluated are each activated separately within the individual measuring periods, with the procedure according to the invention, the light from several light sources is detected simultaneously in at least one of the measuring periods. The fact that the light sources are now no longer always activated individually, but that the mixed light emitted by the light sources is also included at least in part, means that the temporary deviations in the light emission for an observer of the illuminant are significantly more difficult to identify. Ultimately, the light emitted in the calibration phase is changed relatively slightly by comparison with the regular operation, wherein, however, an accurate detection of the light intensity of the individual light sources is possible in spite of everything. Accordingly, the procedure according to the invention once again means that the colour control can be implemented in a reliable manner, wherein, however, it is not necessary to intervene so strongly or even at all in the continuous operation of the illuminant. The measurements for the calibration can therefore be implemented continuously during the normal operation of the illuminant without this being associated with any impairment of the desired light emission.

According to the invention, a device for light emission is therefore proposed, which provides at least three light sources, means for the supply of energy to the light sources, a sensor for detecting the light emitted as a whole from the light sources and a control unit for controlling the means for the supply of energy, wherein the control unit is designed to control the means for the supply of energy within a calibration phase in such a manner that, within a sequence of measuring periods, the light emitted from the light sources is detected by the sensor, and the brightness of each individual light source is calculated on the basis of the information received from the sensor. According to the invention, it is provided that the light detected by the sensor originates, in at least one measuring period, from several of the light sources.

Furthermore, a method for regulating the light emission from at least three light sources is proposed, wherein the light emitted by the light sources is detected during a calibration phase within a sequence of measuring periods, and the brightness of each individual light source is calculated on the basis of the information obtained in the measuring periods, and wherein the method according to the invention is characterised in that the light detected originates, in at least one of the measuring periods, from several of the light sources.

For example, the light sources are controlled in such a manner in the individual measuring periods that exactly one light source is deactivated during each measuring period. This procedure leads to a particularly minimal influence or change of the emitted light by comparison with a regular operation of the illuminant, wherein, however, the light intensity of each individual light source can still be detected very accurately in spite of everything. As an alternative to this, it would be possible to deactivate the light sources respectively one after the other in a sequence of individual measuring periods, so that the overall light emission declines in a stepwise manner, and only the light of a single light source remains in the last measuring period. In this case, the light intensity of each light source can be inferred individually from the signals detected in the individual measuring periods. Accordingly, it is additionally possible to vary the sequence, in which the light sources are deactivated, which will ultimately additionally contribute to the avoidance of lighting effects perceptible by an observer of the illuminant.

In conjunction with the previously named two variants, it should be noted that as an alternative to a complete deactivation of individual light sources, the power of the latter can be reduced or they can be dimmed in such a manner that they emit light below a threshold perceptible by the sensor. In this context, it would still be possible to infer the light intensity of the individual light sources correctly, but, since the human eye is relatively strongly sensitive at low light intensities, the dimming of the light sources would have a less intense impact for an observer of the illuminant.

With the two previously named exemplary embodiments, it can be provided for the sake of simplicity that each measuring period is of the same duration. However, with a third variant, which is associated with particular advantages, the length of the measuring periods can also be adapted in an appropriate manner. This procedure is particularly appropriate if the brightness control of the light sources is implemented by operating the latter with pulse-width-modulated (PWM) signals. In this context, the duration of each of the measuring periods is adapted to the differences between the respective pulse widths for the light sources, which ultimately means that the brightness of the individual light sources can be detected during continuous operation, without any deviation in the control during a calibration phase. This means that during the calibration, no flutter effects or changes in intensity or colour occur.

The light sources of the device according to the invention are preferably formed by light-emitting semiconductor elements or LEDs. In this context, it can, of course, also be provided that in each case, an individual light source is represented by a plurality of LEDs, which emit light of the same colour.

After the brightness for every individual light source has been detected according to the procedure of the invention, a change in intensity, which is attributable to ageing effects, can be compensated by the control unit. For this purpose, the latter is preferably connected to buffering means or respectively provides buffering means, in which reference values for the brightness of the respective light source are buffered. On the basis of a comparison between the brightness values detected in the calibration phase and the reference values, the currents supplied to the light sources can then be adapted during operation in order to compensate corresponding deviations.

The invention is explained in greater detail below with reference to the attached drawings. The drawings are as follows:

DETAILED DESCRIPTION

Figure 1:
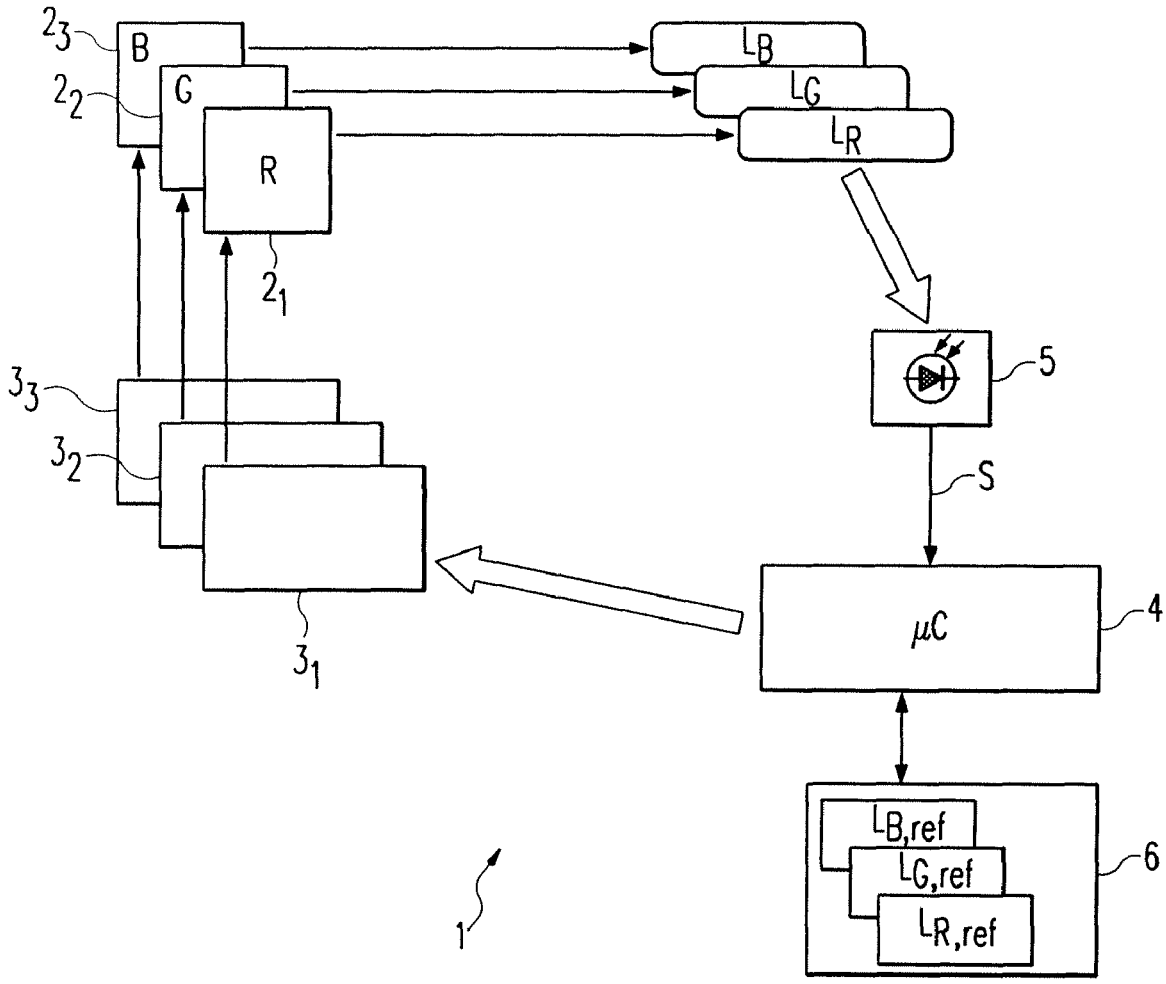
FIG. 1 shows the schematic structure of an exemplary embodiment of the device according to the invention for light emission.

The device for light emission presented in FIG. 1 and indicated in general with the reference number 1 initially provides three light sources $\mathbf{2}_1$ to $\mathbf{2}_3$, which are designed for the emission of light in the colours red ($L_R$), green ($L_G$) and blue ($L_B$). The light sources $\mathbf{2}_1$ to $\mathbf{2}_3$ can each be adjusted in their brightness independently from one another, which opens up the possibility of providing mixed light of almost any required colour shade and any desired intensity. To simplify the presentation, the optical elements required for mixing the light have not been illustrated, but these are already known from the prior art. The mutually independent control of the light sources $\mathbf{2}_1$ to $\mathbf{2}_3$ is achieved by three driver circuits $\mathbf{3}_1$ to $\mathbf{3}_3$, which supply each light source $\mathbf{2}_1$ to $\mathbf{2}_3$ allocated to them with a corresponding power. In this context, the control of the light sources $\mathbf{2}_1$ to $\mathbf{2}_3$ by the driver circuits $\mathbf{3}_1$ to $\mathbf{3}_3$ is implemented on the basis of control signals supplied to the driver circuits $\mathbf{3}_1$ to $\mathbf{3}_3$, which are generated by a control unit 4 of the device for light emission.

The control of the light sources $\mathbf{2}_1$ to $\mathbf{2}_3$ by the driver circuits $\mathbf{3}_1$ to $\mathbf{3}_3$ in order to adjust their brightness can be implemented in different ways. For example, on the one hand, there is the possibility of supplying the light sources $\mathbf{2}_1$ to $\mathbf{2}_3$ with a direct current with variable level. As an alternative to this, it is also possible to operate the light sources $\mathbf{2}_1$ to $\mathbf{2}_3$ in PWM mode, wherein they are supplied with pulse-width-modulated supply currents, and an adjustment of the intensity is implemented by modifying the pulse width. Both of the methods described above are particularly suitable for cases, in which the light sources $\mathbf{2}_1$ to $\mathbf{2}_3$ are formed by LEDs, wherein each light source can also be formed from a number of several LEDs of the same colour.

In order to implement a colour control for the mixed light emitted by the light sources $\mathbf{2}_1$ to $\mathbf{2}_3$, the light emitted by the light sources $\mathbf{2}_1$ to $\mathbf{2}_3$ is now detected as a whole by a sensor 5, for example, a photodiode, which communicates a corresponding signal S to the control unit 4. As will be explained in greater detail below, an appropriate control of the light sources $\mathbf{2}_1$ to $\mathbf{2}_3$ is then implemented in a calibration phase, wherein the brightness is calculated by the control unit 4 for each of the individual light sources $\mathbf{2}_1$ to $\mathbf{2}_3$ from the signals S supplied from the sensor 5. The information obtained in this context is compared with reference values, which are stored in a buffer 6. In this context, the buffer 6 can either be connected to the control unit 4 or can be a component of the control unit 4. On the basis of the comparison values, a corresponding modification of the control of the light sources $\mathbf{2}_1$ to $\mathbf{2}_3$ can then be implemented, in order to compensate any deviations in the light intensity of the individual light sources occurring over time, which are attributable, for example, to ageing effects.

The procedure described in general above for compensating ageing effects in the control of LED light sources, which is also referred to as a feedback loop, was, in principle, already known from the prior art. However, by contrast with the known procedures, the device 1 according to the invention differs in the manner in which the light sources $\mathbf{2}_1$ to $\mathbf{2}_3$ are controlled during the calibration phase and in the manner in which the information obtained accordingly, which is supplied by the sensor 5, is evaluated by the control unit 4. This will be explained below with reference to FIGS. 2 to 5.

Figure 2:
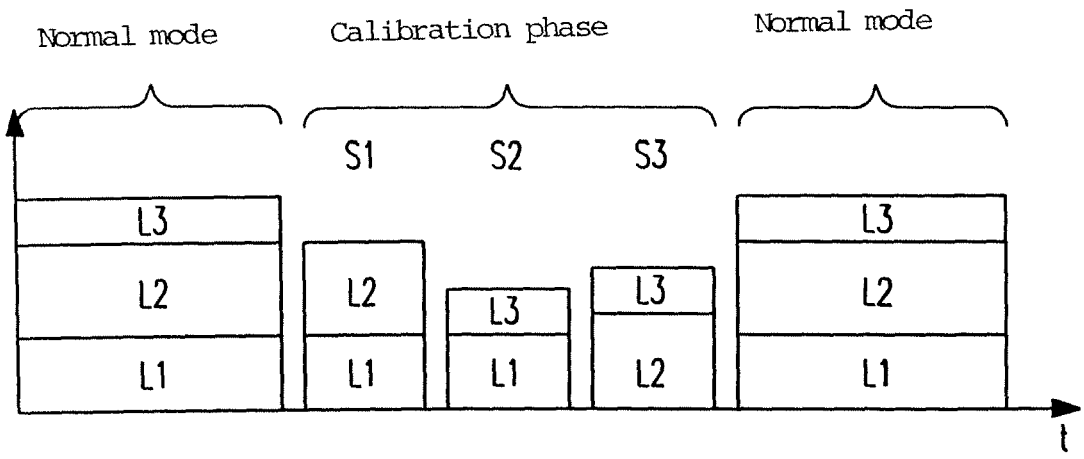
FIG. 2 shows a first scheme for controlling the light sources for the implementation of a calibration.

Accordingly, FIG. 2 initially shows a first exemplary embodiment of the procedure according to the invention, wherein the time course of the signals communicated from the sensor 5 to the control unit 4 is illustrated. Once again, reference is initially made in this context to the fact that the sensor 5 does not distinguish according to the colours of the light emitted from the light sources but merely detects the overall brightness. During normal operation, a signal S, which represents the sum of the brightness values L1, l2 and L3 of the three light sources, is therefore detected by the sensor.

During a calibration phase, the light sources are now controlled within successive measuring periods in such a manner that, in each case, one of the three light sources is deactivated in a targeted manner. Accordingly, in a first measuring period, the third light source is deactivated; in a second measuring period, the second light source is deactivated; and, in a third measuring period, the first light source is deactivated. The signals detected by the sensor during these three measuring periods are then structured as follows:

$$S1=L1+L2$$

$$S2=L1+L3$$

$$S3=L2+L3$$

On the basis of these measured signals S1, S2, S3, the brightness for each individual light source can then readily be determined by the control unit, since the following relationships can be inferred from the three above equations:

$$L1=(S1+S2-S3)/2$$

$$L2=(S1-S2+S3)/2$$

$$L3=(-S1+S2+S3)/2$$

The individual brightness information L1, L2 and L3 obtained in this manner are then compared by the control unit with the reference values stored in the buffer. The current or the power for each of the three light sources can then be adapted in an appropriate manner in order to correspond to the respective reference value, thereby compensating ageing effects. After the conclusion of the calibration phase, the unit is again switched over into a conventional operating mode.

The procedure described above is characterised in that, in all three of the measuring periods, only a single light source is deactivated in each case, or respectively a mixed light is evaluated by the sensor instead of an individual colour. As a result, by contrast with the light signal during the normal operating mode, significantly fewer deviations occur in the individual measuring periods than would be the case, if only a single light source were to be activated in each case. By comparison with the normal operating mode, the deviations occurring in the light emitted by the device as a whole are therefore significantly less readily perceptible by an observer. This is also associated, for example, with the advantage that the measuring periods can be dimensioned to be relatively long without this effect being detectable by an observer. Accordingly, the accuracy in determining the individual light intensities is significantly increased, especially because there is no risk of falsifications in the measured results occurring as a result of short term effects of switching on and off, which can lead to voltage peaks. The measurements during the calibration phase can therefore be implemented without difficulty within the range of approximately 100 Hz, wherein, of course, there would also be the possibility of implementing measurements in the KHz range.

Figure 3:
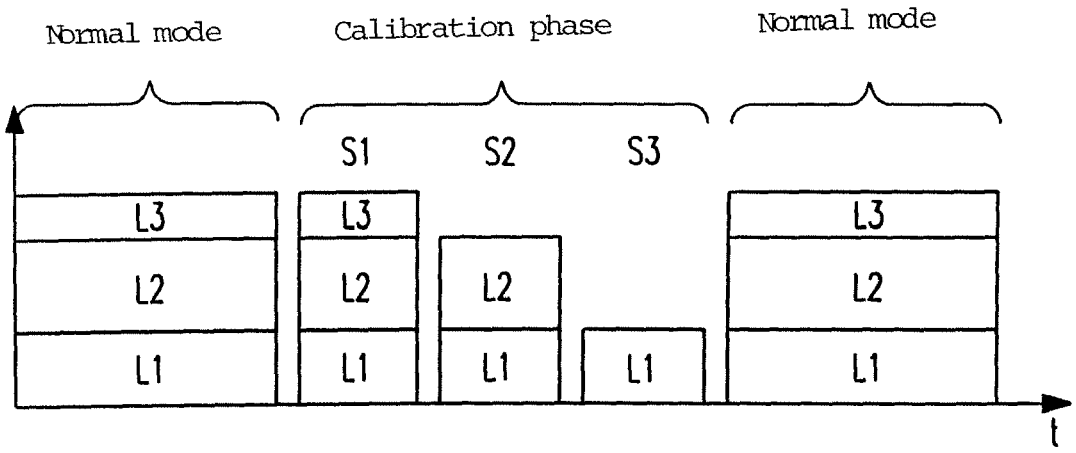
FIGS. 3 to 5 show alternative procedures for controlling the light sources for the calibration.

One variant of the procedure explained with reference to FIG. 2 is illustrated in FIG. 3 and consists in the fact that the light sources are deactivated in succession during the three measuring periods of the calibration phase, so that the following measured signals are obtained:

$$S1=L1+L2+L3$$

$$S2=L1+L2$$

$$S3=L1$$

In this case also, it is possible for the control unit to infer the individual brightness, because now the following applies:

$$L1=S3$$

$$L2=S2-S3$$

$$L3=S1-S2$$

Here also, fewer deviations occur in the first two measuring periods by comparison with the light signals during the normal operating mode, so that no interfering lighting effects occur. This method can be additionally, further optimised in that the sequence, in which the light sources are deactivated within the individual measuring periods, are varied in the successive calibration phases. In this manner, the recurrence of similar lighting or respectively colour sequences is avoided, wherein a variation of this kind in the sequence could also be used with the method according to FIG. 2.

Figure 4:
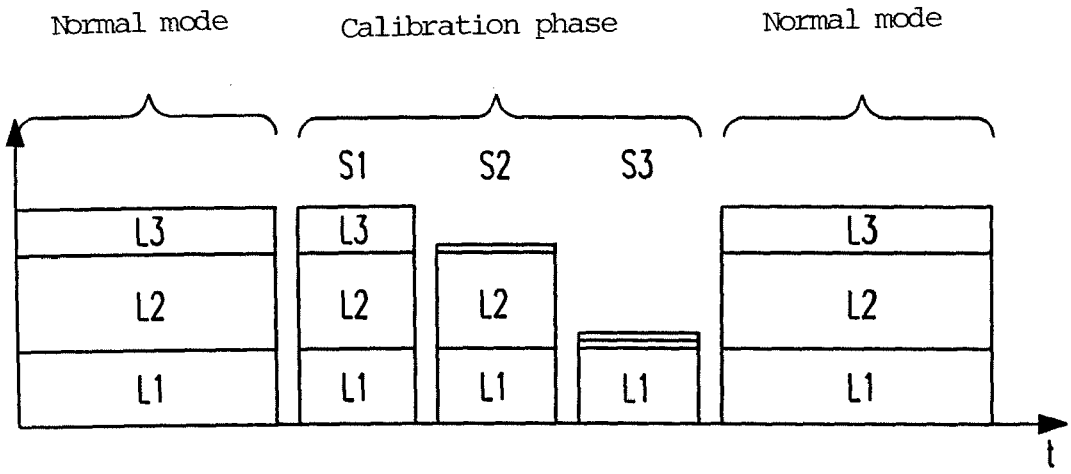

A further possibility for supplementing the method illustrated in FIG. 3 is shown in FIG. 4. In this context, the LEDs are not completely deactivated in the individual measuring periods, but—as indicated schematically—dimmed down to a level, which is disposed below a threshold perceptible by the sensor. In this case, the contribution of this light source to the sensor signal is negligible, for which reason, the previously indicated equations still apply and, accordingly, the intensity of each individual light source can once again be determined. Since, conversely, the sensitivity of the human eye is relatively high with low brightness values, the change in intensity by comparison with the conventional operating mode is once again less for an observer, for which reason this measure—which would, of course, also be usable with the method according to FIG. 2—additionally contributes to the avoidance of interference through the calibration of the light sources.

However, the level below a threshold value, to which it is possible to dim during the calibration phase, can also be disposed above the threshold perceptible by the sensor. The calibration phase can contain at least one measuring period, in which the LEDs are not deactivated or, in the sense of the preceding calibration stages, are not completely activated, but in which at least one LED, several LEDs or also all LEDs are dimmed down to the level below a threshold value. The measurement of this at least one measuring period can be used as calibration information in order to evaluate the information obtained during the calibration phase, taking into consideration the knowledge of the level of the LED below a threshold value, in the sense that the information obtained during the further measuring phases is corrected by this calibration information.

However, one or more LEDs or respectively the optical component of the LED itself or also the optical component of the LED illuminant can be designed in such a manner that light is emitted to the environment and to the sensor only above a certain dimming level (brightness value of the LED), and accordingly, the threshold perceptible by the sensor is defined. In this manner, the level below a threshold can therefore also be disposed below the threshold perceptible by the sensor.

However, the sensor can also provide a defined filter, which defines the threshold for perceptibility. In this context, this threshold value can have different values or also the same value for different wavelengths. The threshold value can be adjustable, for example, dependent upon the calibration information.

Figure 5:
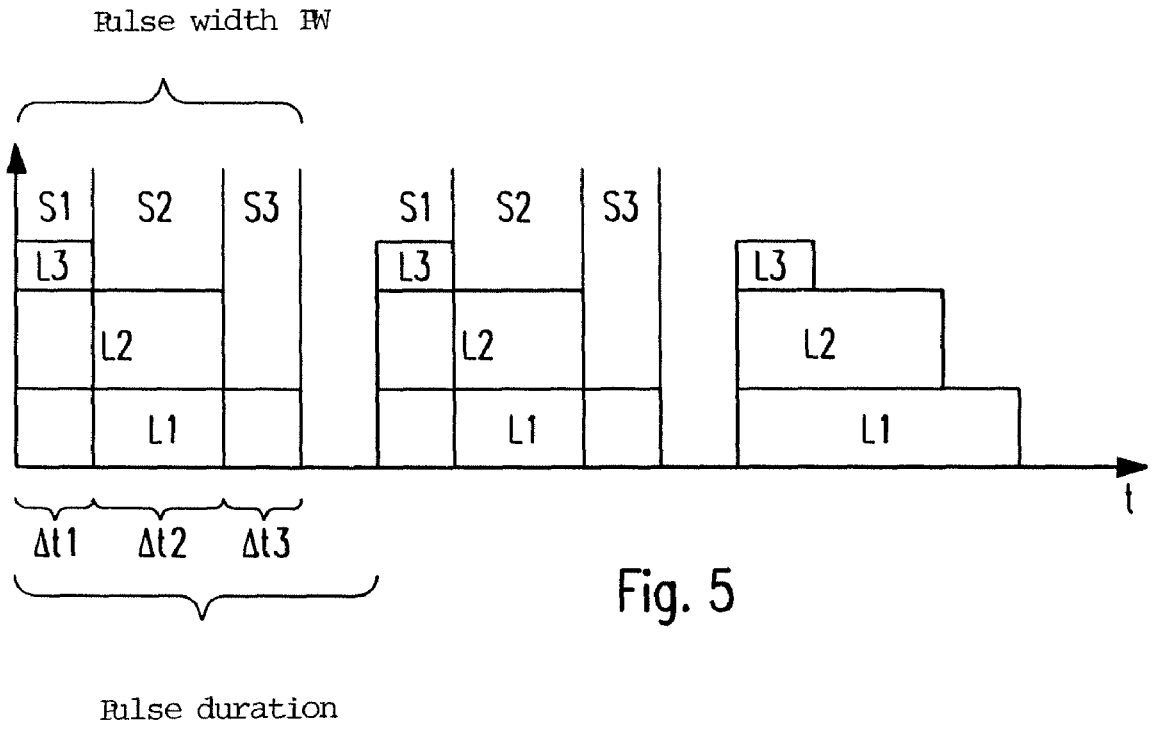

As already mentioned, one advantage of the variants of the procedure according to the invention described so far is that, within the framework of the calibration phase, the intensity deviations relative to the normal operating mode are smaller, so that for an observer, no flutter effects occur. With reference to FIG. 5, a further variant, which can be used if the light sources are operated with pulse-width-modulated signals, will now be described. This type of control of the LEDs is particularly suitable, if the LEDs are to be varied in their intensity, for example, in order to achieve mixed light of a required colour shade. Accordingly, the LEDs are switched on and off in alternation, wherein the time relationship between the turn-on time and the turn-off time influences the average intensity of the respective LED. Accordingly, the intensity of the corresponding light source can be adjusted in an almost infinite manner by varying this duty factor.

FIG. 5 now shows the time course of the signals received by the sensor in the case of a PWM operating mode, wherein the signal sequence reproduces the normal operating mode of the LED illuminant.

The special feature of the method now described is that the light signals generated during the normal operating mode can also be used to determine the intensities L1, L2 and L3 of the individual light sources. This is possible, because the pulse widths for the individual light sources are known (because specified by the control unit) and, from these, the time differences Δt1, Δt2 and Δt3 can be determined.

It would, therefore, now be possible for the sensor to determine the overall intensity of the light emitted by the light sources in a targeted manner in each case briefly within the three time periods and then, as explained above, to determine the intensity of each light source individually. However, the accuracy of the measurements can be increased further, by integrating the signal detected by the sensor over the duration of the respective measuring period. The special feature here is that the measuring periods for a calibration of the light sources can be adapted to these time intervals, wherein the following relationships are obtained for the signals integrated over the three measuring periods and scaled to the pulse-width duration PW:

$$S1^*=L1\cdot\Delta t1/PW+L2\cdot\Delta t1/PW+L3\cdot\Delta t1/PW$$

$$S2^*=L1\cdot\Delta t2/PW+L2\cdot\Delta t2/PW$$

$$S3^*=L1\cdot\Delta t3/PW$$

Once again, the intensity of the respective light source can be calculated from the above according to the following equations $$L1=S3^*\cdot PW/\Delta t3$$

$$L2=(S2^*-S3^*\Delta t2/\Delta t3)\cdot PW/\Delta t2$$

$$L3=(S1^*-S3^*\cdot\Delta t1/\Delta t3-(S2^*-S3^*\cdot\Delta t2/\Delta t3)\cdot PW/\Delta t2)\cdot PW/\Delta t1$$

The advantage of this procedure is that the intensities of the individual light source can be determined during continuous operation, without the need to implement a deviation in the control of the light sources by comparison with conventional operation. In other words, the measures for the calibration of the light sources are no longer perceptible to an observer. Furthermore, this once again means that during operation, a corresponding adjustment of the LEDs can take place in a continuous manner, because a calibration need not be implemented exclusively in given intermediate phases.

The method described above can, furthermore, also be modified to the effect that the timing points, at which the LEDs operated in PWM operating mode are activated, are selected differently. Different start and stop times can then be used for different dimming levels, for example, on the basis of a table, in order to avoid causing regular intensity peaks. Once again, this measure contributes to the reduction of externally perceptible effects during the calibration of the light sources.

The method according to the invention can be used with any devices for light emission, which provide at least three mutually independent, controllable light sources, especially LEDs. In the event that more than three light sources are used, the method can be expanded accordingly without difficulty. The equations resulting in this context for the determination of each of the individual light intensities would then expand accordingly, wherein, however, an unambiguous determination of the individual light intensities is possible for each light source in spite of everything. Accordingly, it is also not absolutely necessary for the various light sources to emit light of a different colour. The prerequisite for the implementation of the method according to the invention is merely that at least two different colours of the light source available.

The measures described above are used, in particular, to compensate deviations in the intensities of the individual light sources, which are attributable to ageing effects. In order to include manufacturing tolerances from the manufacture of the LEDs, the LEDs can also be measured a single time during manufacture, after their assembly, using an appropriate colour sensor, and, for each individual light source, the intensity and colour, at which light is emitted from the corresponding LEDs, can be accurately determined. This information can then be used during subsequent operation in order to determine how strongly the light sources need to be controlled in order to generate light of the required, mixed colour. This measure therefore additionally contributes to ensuring that ultimately, a mixed light is generated, which is disposed exactly at the desired colour location.

Finally, therefore, a possibility is created by the present invention for the adjustment of light sources during the continuous, normal operation of an LED illuminant, without the occurrence of any changes in intensity in the emitted light which are clearly perceptible to an observer. The lighting properties of the device are significantly improved in this manner.

The invention claimed is:

1. A device for light emission (1) comprising a) at least three light sources ($\mathbf{2}_1$, $\mathbf{2}_2$, $\mathbf{2}_3$), b) energy supply elements ($\mathbf{3}_1$, $\mathbf{3}_2$, $\mathbf{3}_3$) configured to supply energy to the light sources ($\mathbf{2}_1$, $\mathbf{2}_2$, $\mathbf{2}_3$), c) a sensor (5) configured to detect the light emission from the light sources ($\mathbf{2}_1$, $\mathbf{2}_2$, $\mathbf{2}_3$) as a whole, and d) a control unit (4) configured to control the energy supply elements ($\mathbf{3}_1$, $\mathbf{3}_2$, $3_3$) for supplying energy to the light sources ($\mathbf{2}_1$, $\mathbf{2}_2$, $2_3$), wherein the control unit (4) is configured to control the energy supply elements ($\mathbf{3}_1$, $\mathbf{3}_2$, $\mathbf{3}_3$) for supplying energy within a calibration phase in such a manner that the light emission from the light sources ($\mathbf{2}_1$, $\mathbf{2}_2$, $\mathbf{2}_3$) is detected by the sensor (5) in a sequence of measuring periods, and to calculate the brightness of each individual light source ($2_1$, $2_2$, $2_3$) on the basis of the information received from the sensor (5), wherein the light detected by the sensor (5) in at least one of the measuring periods originates from several of the light sources ($2_1$, $2_2$, $2_3$).

2. The device according to claim 1, wherein the light sources ($2_1$, $2_2$, $2_3$) are configured to emit light of different colour.

3. The device according to claim 1, wherein the light sources ($2_1$, $2_2$, $2_3$) are each formed from a plurality of LEDs.

4. The device according claim 1, wherein the control unit (4) provides a buffer (6) or is connected to a buffer (6), in which reference values for the brightness of the respective light source ($2_1$, $2_2$, $2_3$) are buffered.

5. The device according to claim 4, wherein the control unit (4) is configured to adapt the power supplied to the light sources ($2_1$, $2_2$, $2_3$) on the basis of a comparison between the brightness values determined in the calibration phase and the reference values.

6. The device according to claim 1, wherein the measuring periods each provide the same duration.

7. The device according to claim 6, wherein, within each measuring period, in each case precisely one of the light sources ($2_1$, $2_2$, $2_3$) is deactivated or respectively dimmed to a level below a threshold value.

8. The device according to claim 6, wherein, within the measuring periods, the light sources ($2_1$, $2_2$, $2_3$) are deactivated or respectively dimmed to a level below a threshold value in a stepwise manner.

9. The device according to claim 1, wherein the measuring periods are different in length.

10. The device according to claim 9, wherein the light sources ($2_1$, $2_2$, $2_3$) are operated in pulse mode, wherein the duration of the measuring periods is dependent upon the pulse widths for the operation of the light sources ($2_1$, $2_2$, $2_3$).

11. A method for controlling the light emission (1) of at least three light sources ($2_1$, $2_2$, $2_3$), comprising:

detecting, during a calibration phase, within a sequence of measuring periods, the light emission from the light sources ($2_1$, $2_2$, $2_3$), and calculating the brightness of each individual light source ($2_1$, $2_2$, $2_3$) on the basis of the information obtained in the measuring periods, wherein, within at least one of the measuring periods, the light detected originates from several of the light sources ($2_1$, $2_2$, $2_3$).

12. The method according to claim 11, wherein the light sources ($2_1$, $2_2$, $2_3$) are configured to emit light of different colour.

13. The method according to claim 12, wherein the light sources ($2_1$, $2_2$, $2_3$) are each formed from a plurality of LEDs.

14. The method according to claim 11, wherein the power supplied to the light sources ($2_1$, $2_2$, $2_3$) is adapted on the basis of a comparison between the brightness values determined in the calibration phase and specified reference values.

15. The method according to claim 11, wherein the measuring periods each provide the same duration.

16. The method according to claim 15, wherein, within every measuring period, in each case precisely one of the light sources ($2_1$, $2_2$, $2_3$) is deactivated or dimmed to a level below a threshold value.

17. The method according to claim 16, wherein, within the measuring periods, the light sources ($2_1$, $2_2$, $2_3$) are deactivated or respectively dimmed to a level below a threshold value in a stepwise manner.

18. The method according to claim 11, wherein the measuring periods are of different length.

19. The method according to claim 16, wherein the light sources ($2_1$, $2_2$, $2_3$) are operated in pulse mode, wherein the duration of the measuring periods is dependent upon the pulse widths for the operation of the light sources ($2_1$, $2_2$, $2_3$).

* * * * *